US005868872A

United States Patent [19]

Karmaschek et al.

[11] Patent Number: 5,868,872

[45] Date of Patent: Feb. 9, 1999

[54] CHROMIUM-FREE PROCESS FOR THE NO-RINSE TREATMENT OF ALUMINUM AND ITS ALLOYS AND AQUEOUS BATH SOLUTIONS SUITABLE FOR THIS PROCESS

[75] Inventors: Uwe Karmaschek, Bergheim; Raschad Mady, Frechen, both of Germany

[73] Assignee: Henkel Kommanditgesellschaft auf Aktien, Duesseldorf, Germany

[21] Appl. No.: 722,261

[22] PCT Filed: Mar. 31, 1995

[86] PCT No.: PCT/EP95/01197

§ 371 Date: Oct. 25, 1996

§ 102(e) Date: Oct. 25, 1996

[87] PCT Pub. No.: WO95/27807

PCT Pub. Date: Oct. 19, 1995

[30] Foreign Application Priority Data

Apr. 8, 1994 [DE] Germany ..... 4412138.5

[51] Int. Cl.[6] ..... C23C 22/48

[52] U.S. Cl. ..... 148/247; 148/251; 148/253; 148/261; 148/275

[58] Field of Search ..... 148/247, 251, 148/253, 261, 275

[56] References Cited

U.S. PATENT DOCUMENTS

| | | | |
|---|---|---|---|
| 3,912,548 | 10/1975 | Faigen | 148/6.15 |
| 4,136,073 | 1/1979 | Muro et al. | 260/29.2 |
| 4,470,853 | 9/1984 | Das et al. | 148/6.15 |
| 4,761,189 | 8/1988 | Mady et al. | 148/6.16 |
| 4,921,552 | 5/1990 | Sander et al. | 148/247 |
| 4,992,116 | 2/1991 | Hallman | 148/247 |
| 5,089,064 | 2/1992 | Reghi | 148/247 |
| 5,129,967 | 7/1992 | Sander et al. | 148/247 |
| 5,158,622 | 10/1992 | Reichgott et al. | 148/247 |
| 5,441,580 | 8/1995 | Tomlinson | 148/247 |

FOREIGN PATENT DOCUMENTS

| | | |
|---|---|---|
| 008 942 | 3/1980 | European Pat. Off. . |
| 2 246 653 | 5/1975 | France . |
| 2 255 393 | 7/1975 | France . |
| 24 33 704 | 1/1975 | Germany . |
| 27 01 927 | 8/1977 | Germany . |
| 32 47 729 | 7/1984 | Germany . |
| 39 00 149 | 7/1989 | Germany . |
| 43 17 217 | 12/1994 | Germany . |
| 2 014 617 | 8/1979 | United Kingdom . |
| 90/12902 | 11/1990 | WIPO . |
| 92/07973 | 5/1992 | WIPO . |
| 95/04169 | 2/1995 | WIPO . |

*Primary Examiner*—David A. Simmons
*Assistant Examiner*—Robert R. Koehler
*Attorney, Agent, or Firm*—Ernest G. Szoke; Wayne C. Jaeschke; Norvell E. Wisdom, Jr.

[57] ABSTRACT

Described is a process using a no-rinse technique for the production of a chromium-free conversion layer on the surface of aluminum and its alloys by treating with an aqueous solution having a pH between 1 and 3.5 and containing titanium and/or zirconium plus an organic film-forming agent. The process is characterized in that the surface is brought into contact with a solution containing a) 2.2 to 22.0 g/l of Zr(IV) and/or 1.4 to 14.0 g/l of Ti(IV), b) 2.4 to 24.0 g/l of orthophosphate, c) 3.0 to 30.0 g/l of fluoride, d) 0.15 to 1.5 g/l of a water-soluble or homogeneously water-dispersible organic film former and, after a contact time between 1 and 40 seconds, the wet surface is allowed to dry, without rinsing, at a temperature between 50° and 125° C. Also described are aqueous concentrates for use in the process.

20 Claims, No Drawings

CHROMIUM-FREE PROCESS FOR THE NO-RINSE TREATMENT OF ALUMINUM AND ITS ALLOYS AND AQUEOUS BATH SOLUTIONS SUITABLE FOR THIS PROCESS

FIELD OF THE INVENTION

Statement of Related Art

This invention relates to the preparation of cleaned metal surfaces, more particularly strips of aluminum or aluminum alloys, for the subsequent application of organic coatings, particularly for the manufacture of metal goods for architectural applications and for the food packaging industry.

So-called "no-rinse" processes are generally known in the chemical treatment of metal surfaces, for example for the subsequent application of paints, adhesives and/or plastics. In no-rinse processes, the metal surfaces are freed from oil, dirt and other residues in a first stage. Any residues of chemicals from this first stage are removed by rinsing with water. In the next stage of the process, the clean metal surface is wetted with an aqueous bath solution which is not rinsed off, but instead is dried in situ on the metal surface and, in the process, is converted into a solid film of the bath ingredients. Coatings such as these can significantly improve the surface quality of covering layers subsequently applied, particularly with respect to corrosion control and adhesion. Originally, treatment solutions containing hexavalent chromium ("yellow chromating") were often proposed in the extensive relevant prior art literature. On account of the toxic character of Cr(VI), these processes or rather the rinsing waters accumulating therein require expensive wastewater treatment. Even processes which only use trivalent chromium (DE-A-32 47 729) were not entirely satisfactory on account of increasing demands for the complete absence of chromium.

The chromium-free conversion treatment of aluminum surfaces with fluorides of boron, silicon, titanium or zirconium alone or in conjunction with organic polymers for obtaining permanent protection against corrosion and for producing a base for subsequent painting is known in principle:

U.S. Pat. Nos. 5,129,967 and 4,921,552 disclose treatment baths for the no-rinse treatment (described there as "dried in place conversion coating") of aluminum containing:

a) 10 to 16 g/l of polyacrylic acid or homopolymers thereof, b) 12 to 19 g/l of hexafluorozirconic acid, c) 0.17 to 0.3 g/l of hydrofluoric acid and d) up to 0.6 g/l of hexafluorotitanic acid.

EP-B-8 942 discloses treatment solutions, preferably for aluminum cans, containing:

a) 0.5 to 10 g/l of polyacrylic acid or an ester thereof and b) 0.2 to 8 g/l of at least one of the compounds $H_2ZrF_6$, $H_2TiF_6$ and $H_2SiF_6$, the pH value of the solution being below 3.5, and an aqueous concentrate for regenerating the treatment solution containing:

a) 25 to 100 g/l of polyacrylic acid or an ester thereof, b) 25 to 100 g/l of at least one of the compounds H2$ZrF_6$, $H_2TiF_6$ and $H_2SiF_6$ and c) a source of free fluoride ions supplying 17 to 120 g/l of free fluoride.

DE-C-24 33 704 describes treatment baths for increasing paint adhesion and permanent protection against corrosion inter alia on aluminum which may contain from 0.1 to 5 g/l of polyacrylic acid or salts or esters thereof and 0.1 to 3.5 g/l of ammonium fluorozirconate, expressed as $ZrO_2$. The pH values of these baths may vary over a wide range. The best results are generally obtained when the pH value is in the range from 6 to 8.

U.S. Pat. No. 4,992,116 describes treatment baths for the conversion treatment of aluminum with pH values of around 2.5 to 5 which contain at least three components, namely:

a) phosphate ions in a concentration of $1.1\times10^{-5}$ to $5.3\times10^{-3}$ moles/l, corresponding to 1 to 500 mg/l, b) $1.1\times10^{-5}$ to $1.3\times10^{-3}$ moles/l of a fluoroacid of an element of the group consisting of Zr, Ti, Hf and Si (corresponding to 1.6 to 380 mg/l, depending on the element) and c) 0.26 to 20 g/l of a polyphenol compound obtainable by reacting poly(vinylphenol) with aldehydes and organic amines.

WO 92/07973 describes a chromium-free treatment process for aluminum which uses 0.01 to around 18% by weight of $H_2ZrF_6$ and 0.01 to around 10% by weight of a 3-(N—$C_{1-4}$-alkyl-N-2-hydroxyethylaminomethyl)-4-hydroxystyrene polymer as essential components in the form of an acidic aqueous solution.

German patent application P 43 17 217.2 describes a process for the pretreatment of surfaces of aluminum or its alloys before a second conversion treatment for permanent corrosion control, in which the surfaces are contacted with acidic aqueous treatment solutions which contain complex fluorides of the elements boron, silicon, titanium, zirconium or hafnium either individually or in admixture with one another in concentrations of the fluoroanions of, in total, 100 to 4,000 and preferably 200 to 2,000 mg/l and which have a pH value of 0.3 to 3.5 and preferably in the range from 1 to 3. The treatment solutions may additionally contain polymers of the polyacrylate type and/or in the form of reaction products of poly(vinylphenol) with aldehydes and organic hydroxyfunctional amines in concentrations below 500 mg/l and preferably below 200 mg/l. Phosphoric acid is another optional constituent of these baths.

U.S. Pat. No. 4,136,073 claims a chromium-free treatment process for aluminum surfaces, in which the surfaces are contacted with acidic (pH 1.2 to 5.5) aqueous solutions containing an organic film former and a soluble titanium compound in a ratio by weight of polymer to titanium of 100:1 to 1 :10. The preferred titanium concentration is between 0.01 and 5% by weight.

DESCRIPTION OF THE INVENTION

Object of the Invention

The problem addressed by the present invention was to provide a chromium-free no-rinse process of the type mentioned at the beginning and suitable treatment baths which would lend themselves to architectural applications and, in particular, to applications in the food packaging industry. In particular, the requirements typical of food applications, including for example sterilizability of the pack produced from the treated material and the avoidance of so-called "feathering", i.e. removal of the coating during the opening of cans, would have to be satisfied. At the same time, the process according to the invention would provide a uniform, visually attractive finish on the metal surface which, for example in the event of subsequent coating with clear lacquers, would satisfy the aesthetic requirements typical in particular of the food packaging industry.

SUMMARY OF THE INVENTION

Accordingly, the present invention relates to a process for the production of chromium-free conversion coatings on surfaces of aluminum and its alloys by the no-rinse process by treatment with aqueous solutions having a pH value of 1 to 3.5 and containing titanium and/or zirconium and organic film formers, characterized in that the surfaces are contacted with solutions containing:

a) 2.2 to 22.0 g/l of Zr(IV) and/or 1.4 to 14.0 g/l of Ti(IV), b) 2.4 to 24.0 g/l of orthophosphate, c) 3.0 to 30.0 g/l of fluoride, d) 0.15 to 1.5 g/l of a water-soluble or homogeneously water-dispersible organic film former, and the solutions are dried on the surface without rinsing after a contact time of 1 to 40 seconds at temperatures of 50° to 125° C.

DESCRIPTION OF PREFERRED EMBODIMENTS

In a preferred embodiment, the treatment solutions contain:

a) 4.3 to 13.0 g/l of Zr(IV) and/or 2.8 to 8.5 g/l of Ti(IV), b) 4.8 to 14.3 g/l of orthophosphate, c) 6.0 to 18.2 g/l of fluoride, d) 0.28 to 0.82 g/l of a water-soluble or homogeneously water-dispersible organic film former.

The various requirements which the behavior of the coating are expected to meet are best satisfied by treatment solutions containing both Ti(IV) and Zr(IV), a ratio by weight of Ti to Zr of 3:1 to 1:3 being particularly preferred. The pH value of the solutions is preferably between 1.5 and 2.5. The fluoride is preferably used as complexed fluoride, for example as $TiF_6^{2-}$ or $ZrF_6^{2-}$.

The organic film former is preferably a synthetic polymer with a sufficient content of free carboxyl groups to guarantee its solubility in water or homogeneous dispersibility in water in the process-relevant pH range. Particularly suitable organic film formers are polymers of acrylic acid and/or methacrylic acid which may optionally contain limited quantities of copolymers and the corresponding esters, nitriles and/or amides. Preferred organic film formers are transparently soluble polyacrylic acids which retain their transparent solubility in particular at the pH value of the aqueous treatment baths. In general, the polyacrylic acids in question are those which do not have an excessively high molecular weight, for example those having molecular weights of 20,000 to around 150,000 and preferably in the range from 40,000 to around 100,000.

In the process according to the invention, a conventionally cleaned and rinsed metal surface, after rinsing with deionized water and drying and/or removal of the water film by squeegees, is wetted in any manner with the aqueous treatment solution in such a quantity that around 3 to 10 ml and preferably around 4 to 8 ml of the aqueous treatment solution are applied per square meter of surface area.

The aqueous treatment solutions according to the invention may be applied to the precleaned metal strips by any method which is capable of producing a uniform, defined liquid film on the metal surface in the quantity ranges indicated. The roller application process using two or three rollers ("chemcoater") has proved to be particularly effective, although wetting of the strip by spraying or immersion and subsequent removal of the excess liquid film, for example by plastic-coated equalizing rollers or an adjustable air knife, is also suitable. The temperature of the treatment solution may be in the range from 15° to 50° C. and is preferably in the range from 20° to 35° C.

The liquid film applied to the metal surface is allowed to react thereon for about 1 to 40 seconds, after which the film is dried and heat-treated at elevated temperature. However, the process steps of contact with the metal surface and drying may also be combined. After drying, a formable, water-insoluble solid film with a weight per unit area of around 50 to 350 mg/m$^2$ and preferably around 100 to 250 mg/m$^2$ is left on the metal surface. The drying and/or heat treatment of the liquid film applied to the metal surface, or rather of the chemicals applied with it, may be carried out at temperatures of around 50° to 125° C., temperatures in the range from 50° to 80° C. being preferred.

Both acidic and alkaline cleaners are suitable for the cleaning pretreatment of the metal surfaces to be wetted in accordance with the invention. The layers obtained with the aqueous treatment solution according to the invention provide a uniform finish with no discoloration of the substrate. In combination with suitable organic coatings subsequently applied, they satisfy the requirements of the food packaging industry.

The present invention also relates to the aqueous concentrates of the treatment solutions suitable for this process. The concentrates are advantageously formulated in such a way that they are diluted with 2 to 50 parts by weight of water per part by weight of concentrate for use in the process according to the invention.

EXAMPLES

Within the usual process sequence for no-rinse products, comprising the steps of:

1. cleaning and degreasing (with surfactant-containing alkaline or acidic cleaners—for example RIDOLINE® C 72 or RIDOLINE® 124/120 E—applied by spraying at a treatment temperature of 50° to 65° C. for treatment times of 8 to 20 s),
2. rinsing with process water,
3. rinsing with deionized water,
4. drying,
5. application of the pretreatment using no-rinse technology (laboratory application using a centrifugal "paint thrower"; throwing for 5 seconds at 550 r.p.m.; bath temperature 30° C. {for the composition of the bath, see Table 1}; pH value of the baths 2.0),
6. drying (recirculating air cabinet, 70° C.),
7. painting, the actual surface treatment was carried out in accordance with step 5 with variants listed in the following Tables.

Table 1 contains bath compositions according to the invention while Table 3 contains Comparison Examples in which either the phosphate component or the polymer component was omitted. The relevant test results are set forth in Table 4.

TABLE 1

| | Bath Composition | | | | |
|---|---|---|---|---|---|
| | Example 1 | Example 2 | Example 3 | Example 4 | Example 5 |
| $Ti^{4+}$ | — | 7.1 g/l | 3.6 g/l | 7.1 g/l | 3.6 g/l |
| $Zr^{4+}$ | 10.8 g/l | — | 5.4 g/l | 5.4 g/l | 10.8 g/l |
| $PO_4^{-3}$ | 12.0 g/l | 12.0 g/l | 12.0 g/l | 12.0 g/l | 12.0 g/l |
| $F^-$ | 13.5 g/l | 16.9 g/l | 15.2 g/l | 23.7 g/l | 22.0 g/l |
| O.P.* | 0.7 g/l | 0.7 g/l | 0.7 g/l | 0.7 g/l | 0.7 g/l |
| L.F.** | 6 ml/m$^2$ | 6 ml/m$^2$ | 6 ml/m$^2$ | 6 ml/m$^2$ | 6 ml/m$^2$ |

*Organic film former: polyacrylic acid "Acrylsol A1", a product of Rohm & Haas

**Application of liquid film

The following metal and total coating weights per unit area were obtained with the variants mentioned above after the liquid film had been dried at 70° C. (Table 2):

TABLE 2

| Coating Weights Per Unit Area | | | | | |
|---|---|---|---|---|---|
| | Example 1 | Example 2 | Example 3 | Example 4 | Example 5 |
| Ti | — | 43 mg/m$^2$ | 22 mg/m$^2$ | 43 mg/m$^2$ | 22 mg/m$^2$ |
| Zr | 65 mg/m$^2$ | — | 33 mg/m$^2$ | 32 mg/m$^2$ | 65 mg/m$^2$ |
| T.C.W.*** | 222 mg/m$^2$ | 220 mg/m$^2$ | 220 mg/m$^2$ | 293 mg/m$^2$ | 295 mg/m$^2$ |

***Total coating weight

Test results

1. Architectural Field

Alloys:

Al99.5

AlMn1Mg0.5

Paint system:

1-layer polyester "PE-25", a product of Bollig & Kemper a) T-Bend Test (Bending of the strip edge through 180° and stripping with Tesa tape)

1=very good; no separation

5=defective; complete separation

| | Al99.5 | AlMn1Mg0.5 |
|---|---|---|
| Strip only degreased | 5 | 5 |
| Comparison: yellow chromating (Alodine ® 1200, a product of Henkel KGaA) | 4 | 4 |
| Example 1 | 5 | 5 |
| Example 2 | 2 | 1 |
| Example 3 | 3 | 3 |
| Example 4 | 1 | 1 |
| Example 5 | 2 | 2 |

b) Coin Test (The paint is vigorously scratched with the edge of a coin at an angle of 45°)

Evaluation:

1=Top coat is scratched off, primer remains undamaged or one-component paint is not damaged 2=Primer damage<5% or one-component paint damage<5%

3=Primer damage max, 30% or one-conponent paint damage max. 30%

4=Primer damage up to 75% or one-component paint damage up to 75%

5=Primer damage 100% or one-component paint damage 100%

| | Al99.5 | AlMn1Mg0.5 |
|---|---|---|
| Strip only degreased | 5 | 5 |
| Comparison: yellow chromating (Alodine ® 1200, a product of Henkel KGaA) | 3 | 5 |

-continued

| | Al99.5 | AlMn1Mg0.5 |
|---|---|---|
| NO-RINSE pretreatment ($Cr^{6+}$-containing, Alodine ® NR 6012S, a product of Henkel KGaA) | 1 | 1 |
| Example 1 | 5 | 5 |
| Example 2 | 1 | 2 |
| Example 3 | 3 | 3 |
| Example 4 | 1 | 1 |
| Example 5 | 2 | 2 |

2. Food Industry

Feathering Test

Alloy:

AlMg5

Lacquer system:

Dexter/Midland L3E 692 S

Evaluation:

After boiling of a lacquered section of alloy strip in deionized water, the tearing off of a closure from a beverage can is simulated.

1=Very good: clean removal; no projecting or missing lacquer

5=Defective: an approx. 1 mm or larger projecting lacquer film can be seen.

Classification: 1–5

| | AlMg5 |
|---|---|
| Strip only degreased | 4–5 |
| Comparison: no-rinse pretreatment (Cr(III)-containing: Alodine ® NR 6207 R, (Henkel KGaA) | 1 |
| Example 1 | 1–2 |
| Example 2 | 1 |
| Example 3 | 1–2 |
| Example 4 | 1 |
| Example 5 | 1 |

Comparison Examples

TABLE 3

| | Bath Compositions | | | | | | | | | |
|---|---|---|---|---|---|---|---|---|---|---|
| | Comp. 1 | Comp. 2 | Comp. 3 | Comp. 4 | Comp. 5 | Comp. 6 | Comp. 7 | Comp. 8 | Comp. 9 | Comp. 10 |
| $Ti^{4+}$ | — | 7.1 g/l | 3.6 g/l | 7.1 g/l | 3.6 g/l | — | 7.1 g/l | 3.6 g/l | 7.1 g/l | 3.6 g/l |
| $Zr^{4+}$ | 10.8 g/l | — | 5.4 g/l | 5.4 g/l | 10.8 g/l | 10.8 g/l | — | 5.4 g/l | 5.4 g/l | 10.8 g/l |
| $PO_4^{-3}$ | — | — | — | — | — | 12.0 g/l | 12.0 g/l | 12.0 g/l | 12.0 g/l | 12.0 g/l |
| $F^-$ | 13.5 g/l | 16.9 g/l | 15.2 g/l | 23.7 g/l | 22.0 g/l | 13.5 g/l | 16.9 g/l | 15.2 g/l | 23.7 g/l | 22.0 g/l |
| O.P.* | 0.7 g/l | 0.7 g/l | 0.7 g/l | 0.7 g/l | 0.7 g/l | — | — | — | — | — |
| L.F.** | 6 ml/m$^2$ | 6 ml/m$^2$ | 6 ml/m$^2$ | 6 ml/m$^2$ | 6 ml/m$^2$ | 6 ml/m$^2$ | 6 ml/m$^2$ | 6 ml/m$^2$ | 6 ml/m$^2$ | 6 ml/m$^2$ |

*Organic film former: polyacrylic acid "Acrylsol A1", a product of Rohm & Haas
**Application of liquid film

TABLE 4

| Test Results of the Comparison Examples | | | | | |
|---|---|---|---|---|---|
| Comparison Examples | T-Bend Test Al99.5/ AlMn1Mg0.5 | | Coin Test Al99.5/ AlMn1Mg0.5 | | Feathering Test AlMg5 |
| Comp. 1 | 5 | 5 | 5 | 5 | 4–5 |
| Comp. 2 | 4 | 4 | 5 | 5 | 4–5 |
| Comp. 3 | 4 | 4 | 5 | 5 | 4–5 |
| Comp. 4 | 4 | 4 | 5 | 4–5 | 4–5 |
| Comp. 5 | 4 | 4 | 5 | 5 | 4–5 |
| Comp. 6 | 5 | 5 | 4–5 | 5 | 5 |
| Comp. 7 | 5 | 5 | 5 | 5 | 5 |
| Comp. 8 | 5 | 5 | 5 | 4–5 | 5 |
| Comp. 9 | 5 | 5 | 5 | 5 | 5 |
| Comp. 10 | 5 | 5 | 5 | 5 | 5 |

The invention claimed is:

1. A process for the production of a chromium-free conversion coating on a surface of aluminum or its alloys by a no-rinse process by treatment with an aqueous solution having a pH value of 1 to 3.5 and containing:

a) 2.2 to 22.0 g/l of Zr(IV), 1.4 to 14.0 g/l of Ti(IV), or both, b) 2.4 to 24.0 g/l of orthophosphate, c) 3.0 to 30.0 g/l of fluoride, and d) 0.15 to 1.5 g/l of a water-soluble or homogeneously water-dispersible organic film former, wherein the solutions are, at temperatures of 50° to 125° C. dried on the surface without rinsing after a contact time of 1 to 40 seconds between said surface and said aqueous solution.

2. A process as claimed in claim 1, wherein the treatment solutions contain:

a) 4.3 to 13.0 g/l of Zr(IV), 2.8 to 8.5 g/l of Ti(IV), or both, b) 4.8 to 14.3 g/l of orthophosphate, c) 6.0 to 18.2 g/l of fluoride, d) 0.28 to 0.82 g/l of a water-soluble or homogeneously water-dispersible organic film former.

3. A process as claimed in claim 2, wherein the treatment solution contains both titanium and zirconium, the ratio by weight of Ti to Zr being from 3:1 to 1:3.

4. A process as claimed in claim 3, wherein the organic film former is a homopolymer or copolymer of acrylic acid, methacrylic acid, or both, and has an average molecular weight in the range from 40,000 to 100,000.

5. A process as claimed in claim 4, wherein the treatment solution has a temperature in the range from 20° to 35° C.

6. A process as claimed in claim 5, wherein the treatment solution has a pH value of 1.5 to 2.5.

7. A process as claimed in claim 6, wherein the treatment solution is applied to the metal surface in the form of a liquid film in a quantity of 4 to 8 ml/m$^2$.

8. A process as claimed in claim 7, wherein the liquid film is dried at a temperature of 50° to 80° C.

9. An aqueous concentrate which, by dilution with 2 to 50 parts by weight of water per part by weight of concentrate, produces an aqueous solution having a pH value of 1 to 3.5 and containing:

a) 2.2 to 22.0 g/l of Zr(IV), 1.4 to 14.0 g/l of Ti(IV), or both, b) 2.4 to 24.0 g/l of orthophosphate, c) 3.0 to 30.0 g/l of fluoride, and d) 0.28 to 0.82 g/l of a water-soluble or homogeneously water-dispersible organic film former.

10. An aqueous concentrate as claimed in claim 9 which, by dilution with 2 to 50 parts by weight of water per part by weight of concentrate, produces an aqueous solution containing:

a) 4.3 to 13.0 g/l of Zr(IV), 2.8 to 8.5 g/l of Ti(IV), or both, b) 4.8 to 14.3 g/l of orthophosphate, c) 6.0 to 18.2 g/l of fluoride, d) 0.28 to 0.82 g/l of a water-soluble or homogeneously water-dispersible organic film former that is a homopolymer or copolymer of acrylic acid, methacrylic acid, or both and has an average molecular weight of 20,000 to 150,000.

11. An aqueous concentrate as claimed in claim 10 which, by dilution with 2 to 50 parts by weight of water per part by weight of concentrate, produces an aqueous solution that contains both titanium and zirconium, the ratio by weight of Ti to Zr being from 3:1 to 1:3.

12. An aqueous concentrate as claimed in claim 11, wherein the organic film former is a homopolymer or copolymer of acrylic acid, methacrylic acid, or both, and has an average molecular weight of 20,000 to 150,000.

13. A process as claimed in claim 1, wherein the treatment solution contains both titanium and zirconium, the ratio by weight of Ti to Zr being from 3:1 to 1:3.

14. A process as claimed in claim 1, wherein the organic film former is a carboxyfunctional polymer and has an average molecular weight of 20,000 to 150,000.

15. A process as claimed in claim 14, wherein the carboxyfunctional polymer is a homopolymer or copolymer of acrylic acid, methacrylic acid, or both, and has an average molecular weight of 40,000 to 100,000.

16. A process as claimed in claim 1, wherein the treatment solution has a temperature of 15° to 50° C.

17. A process as claimed in claim 16, wherein the treatment solution has a temperature in the range from 20° to 35° C.

18. A process as claimed in claim 1, wherein the treatment solution has a pH value of 1.5 to 2.5.

19. A process as claimed in claim 1, wherein the treatment solution is applied to the metal surface in the form of a liquid film in a quantity of 3 to 10 mi/$m^2$.

20. A process as claimed in claim 1, wherein the liquid film is dried at a temperature of 50° to 80° C.

* * * * *